United States Patent [19]

Haas et al.

[11] 3,949,942

[45] Apr. 13, 1976

[54] VIBRATING BALL MILL WITH HEAT INSULATED GRINDING CHAMBER

[75] Inventors: Helmut Haas, Proz-Wahn; Freidhelm Haude, Cologne, both of Germany

[73] Assignee: Klockner-Humboldt-Deutz Aktiengesellschaft, Germany

[22] Filed: Oct. 25, 1974

[21] Appl. No.: 518,061

[30] Foreign Application Priority Data

Oct. 27, 1973 Germany ..... 2353964

[52] U.S. Cl. ..... 241/179; 241/67

[51] Int. Cl.[2] ..... B02C 17/18

[58] Field of Search ..... 241/175, 179, 66, 67

[56] References Cited

UNITED STATES PATENTS 3,838,825 10/1974 Haas et al. ..... 241/175

*Primary Examiner*—Roy Lake
*Assistant Examiner*—E. F. Desmond
*Attorney, Agent, or Firm*—Hill, Gross, Simpson, Van Santen, Steadman, Chiara & Simpson

[57] ABSTRACT

A vibrating ball mill having a pair of vertically spaced horizontally disposed grinding chambers rigidly mounted as a unit in a vibrating support frame. Each grinding chamber is enclosed by an insulating sleeve and at the connecting joint between the outer wall of the grinding chamber and the supporting frame a supporting device is arranged which has good insulating characteristics and is able to appropriately transfer the accelerating forces from the supporting frame to the grinding chamber.

11 Claims, 4 Drawing Figures

VIBRATING BALL MILL WITH HEAT INSULATED GRINDING CHAMBER

This invention relates to a grinding mill having at least one horizontally disposed longitudinally extending grinding chamber which is surrounded by an insulating jacket and is secured to a frame which is yieldably mounted and is provided with a vibratory drive.

From the German Laid Open Specification No. 2,063,740, a ball mill is known having a heat-insulated grinding chamber in which an intermediate space exists between the outer wall of the grinding chamber and the supporting frame at the connecting point between the grinding chamber and supporting frame. In this intermediary space there are arranged one or several supporting devices with heat-insulating characteristics and said devices transfer the accelerating forces from the supporting frame to the grinding chamber. The grinding chamber is at this point held fast to the supporting frame by a clamp secured to the supporting frame by clamping screws. If in this arrangement, for example, the space between the outer wall of the grinding chamber and the supporting frame is substantially of the same size as the thickness of the insulating sleeve, then in the area of the connecting means between grinding chamber and supporting frame, "cold losses" are to a great extent prevented, without the necessity of using the insulating sleeve as a connecting means between the grinding chamber and the carrier frame. A substantial problem arises when securing the grinding chamber to the supporting frame, in addition to maintaining an effective insulation. Material expansion or contraction of the grinding chamber which may result by virtue of the great temperature difference between the normal room temperature and the operating temperature, for example, +20° C to −150° C must be overcome upon starting or shutting down the unit. The securing means cannot be released while the mill is operating and cooling down to −150° C and it must be able without retightening to absorb the contraction or the expansion, respectively, occurring at these temperatures when the mill is shut down without additional operations.

The purpose of the invention herein is to improve a vibrating mill of the type described in German Laid Open Specification No. 2,063,740.

SUMMARY OF THE INVENTION

It is an object of the invention, therefore, to provide at the connecting point between the grinding chamber and supporting frame an elastically deformable supporting ring which has on its inner and on its outer side, supporting members spaced from one another, whereby the supporting members of the outer side are arranged offset with respect to the supporting members of the inner side. This arrangement in accordance with the invention, has the advantage that by means of a simple securing of the supporting frames, an initial stress is applied to the elastic supporting device which is sufficiently great so that upon operation at the lowest possible temperature of −190° C which occurs, for example, when the grinding chambers of the mill are filled with liquid nitrogen, a residual stress of the supporting ring yielding inwardly remains. Thereby, the grinding chamber contraction is equalized under the influence of the liquid freezing mixture introduced into the grinding chamber at the most favorable point for such an equalization, that is, directly above the surface of the sleeve of the grinding chamber. Thereby it is possible to construct the supporting frame securing device more easily and more simply.

Another object of the invention is to provide that at least part of the supporting device forming the supporting member consists of a heat-insulating material. This construction advantageously results in the elastic supporting ring not being cooled to the temperature of the grinding chamber, but instead maintaining a temperature which is relatively close to room temperature. For this reason, the elastic part may consist of normal materials which do not need to be temperature resistant. In spite of this, the desired low heat transfer to the outside to the supporting frames is insured.

Another object is to provide on the outer side of the elastically deformable supporting ring at least one annular supporting member and on the inner side at least two annularly supporting members. This arrangement of the supporting members insures that even with the smallest transverse dimension of the supporting device, a stable positioning of the device is assured without the danger of tilting.

Another object of the invention is to provide an elastically deformable supporting ring which preferably consists of metal and supporting members which preferably consist of synthetic material reinforced with fiber. In this way, in an advantageous manner, a functional distribution for the material is attained within the supporting device. Thus, the elastic characteristics of the metal are made use of just as are the heat-insulating characteristics of the synthetic material. A resilient element results which in its bracing effect and flexibility acts substantially better than a construction wherein the supporting frames are resilient elements. Thus, the changes in diameter of the grinding chamber are equalized in operation directly above its surface.

Another object of the invention is to provide a supporting device which comprises a fiber-reinforced portion of synthetic material, arcuate in cross-section and which is at the same time elastic and insulating and has supporting members offset with respect to one another. In this connection, it is a question of an advantageous, one part supporting device in which the supporting members are an integral part of the elastic part. Thus, only one part must be produced and mounted. Accordingly, the mounting and production costs may be decreased.

Another object of the invention is to provide a supporting device which comprises at least two ring parts split in radial direction. In this way a mounting may be attained by placing the lower ring part in the mill frames and the upper ring part on the grinding chamber. This eliminates the necessity of sliding a closed ring onto the grinding chamber. Furthermore, a longitudinal expansion of the supporting device under tension of the supporting frames is made possible. In this way a non-uniform distribution of pressure and a wave-shaped application of the supporting device on the grinding tubes and the supporting frames is prevented.

A still further object of the invention is to provide supporting members which comprise ribs or blocks arranged in a staggered relationship with respect to one another and which extend in transverse direction of the supporting ring. In this way a large distance which is important for resiliency may be provided between the supporting members without increasing the width of the supporting device. In addition, in this embodiment greater surface flaws, such as non-polished welding seams, etc. can be tolerated, as the supporting ring in any case assumes under stress a wave-shaped configuration.

Further objects and advantages will become more apparent when considering the following description and accompanying drawings.

DESCRIPTION OF PREFERRED EMBODIMENTS

Figure 1:
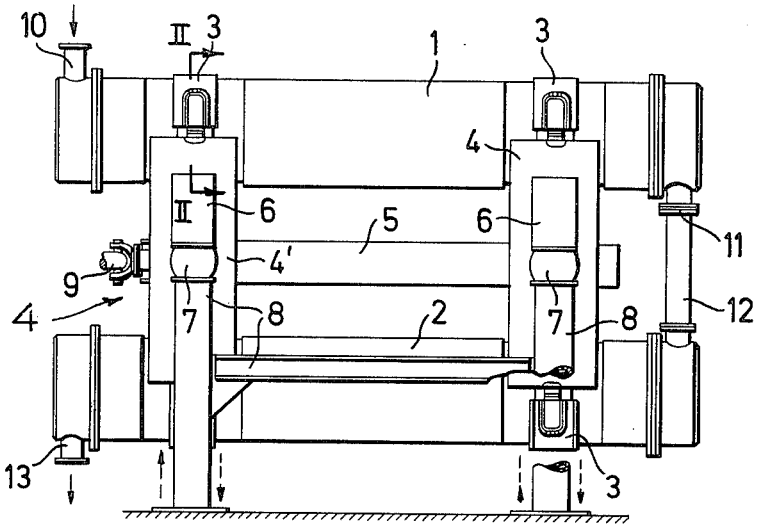
FIG. 1 is a view in elevation of a vibrating mill provided with two horizontally disposed vertically spaced grinding chambers.

The vibrating mill shown diagrammatically in FIG. 1 comprises two parallel grinding chambers 1 and 2 which are rigidly connected by clamping stirrups 3 to a supporting frame comprising two bracket members 4 and a horizontally disposed connecting tube 5 extending between and connecting the bracket members 4. Posts 6 are connected to each side of the bracket members 4, and resilient members here shown as rubber springs 7 interconnect the lower ends of the posts 6 with the upper ends of a fixed mounting stand 8. The unit comprising the grinding chamber 1 and supporting frame brackets are resiliently and oscillatably supported on the fixed mounting stand 8. A vibratory drive is arranged in the middle between the two grinding chambers and parallel to their longitudinal axis. The vibratory drive comprises rotatably mounted, preferably adjustable, unbalanced weights which in each case are disposed in the interior of the connecting tube 5 and are connected with one another by means of a coupling shaft lying in the connecting tube 5. The eccentric weights are connected by means of a universal joint shaft 9 to a driving motor (not shown).

A supply conduit 10 for the material to be ground is connected to the left end of the grinding chamber 1. At the other end of the grinding chamber 1 there is arranged on the lower side thereof an outlet opening 11 through which the material which has been ground in the grindng chamber 1 is discharged through a connecting pipe 12 for further grinding into the grinding chamber 2 lying therebelow. The left hand end of the grinding chamber 2 is provided with a material discharge opening 13 through which the finished ground material is discharged from the vibrating mill, so that the material passes consecutively through the two grinding chambers.

Together with the material to be ground or, as the case may be, by means of separate supply openings, depending on the type of grinding operation, cooling means, for example, highly cooled or liquid gases, preferably liquid nitrogen, are introduced into the grinding chambers to cool the grinding chambers to a temperature of −20° C to −150° C.

Figure 2:
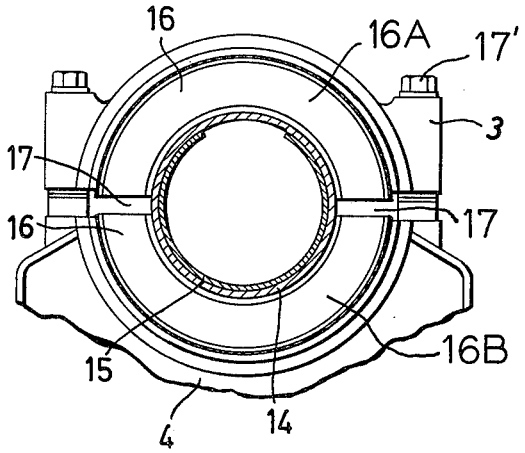
FIG. 2 is a cross-sectional view in elevation through a grinding chamber in the area of the connecting point with the supporting frame taken along line II—II of FIG. 1 and including an inserted supporting device.

The cross-section through the grinding chamber 1 shown in FIG. 2 and taken along line II—II of FIG. 1, shows the construction of the vibrating mill in the area of the connection of the grinding chamber 1 with the supporting frame. The grinding chamber comprises an inner grinding tube 14 into which is slidably inserted a metal wear liner or plate 15. As is apparent from the sectional views in FIG. 3 and 4, the grinding tube 14 is surrounded on its outside by an insulating sleeve 22 which, for example, may consist of polyurethane foam. The insulating material is surrounded on its outer side by a thin metal sleeve 23 for protection against damage. In the area of the connecting joint of the grinding tube 14 with the support frame, there is disposed between the grinding tube 14 and support frame a supporting device 16. The supporting device is formed in two semi-circular halves 16A and 16B, the ends of which do not touch thereby defining spaces 17 between the ends. This makes it possible to clamp the supporting device without any difficulty.

Figure 3:
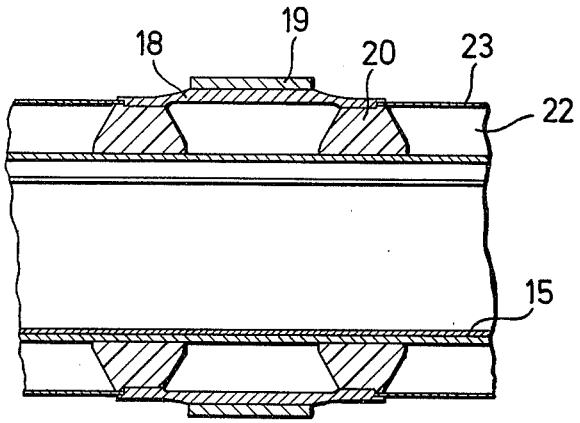
FIG. 3 is a partial view in elevation showing a supporting device in cross-section having offset supporting member.

In FIG. 3 is shown an arrangement of a thin elastically deformable supporting ring 18 with two annularly-shaped longitudinally spaced supporting members 20 which may comprise synthetic material reinforced with fibers. The members 20 surround and are supported on the grinding chamber. An annular supporting member 19 is centrally disposed on and surrounds the ring 18 and is clamped in place by the supporting frame 4. The connection between the supporting members 20 and the elastic ring 18 of the supporting device are characterized by a form-locking construction which also is effective to hold the thin outer metal sleeve of the insulation in place. In this preferred embodiment, the supporting members extend transversely to the axis of the grinding chamber. Supporting members extending transversely to the plane of the elastic supporting ring in the form of ribs or blocks and not rings may also be used.

Figure 4:
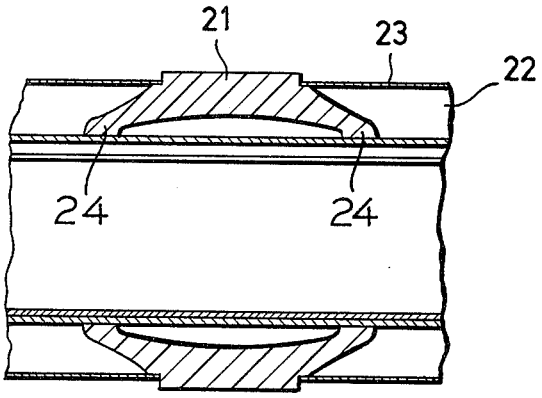
FIG. 4 is a partial view in elevation showing the cross-section through a supporting device of an elastic synthetic material part which is as arcuate in cross-section and has good insulating characteristics.

In FIG. 4 is shown a cross-section through an annular supporting member 21 made of synthetic material which is arcuate in cross-section and which is resilient and has insulating properties. The supporting member 21 is formed with a pair of supporting feet 24 offset with respect to one another and formed on the outer edges of the member 21. The annularly-shaped supporting feet 24 are formed as an integral part of the resilient part. This structure may be advantageously produced from a fiber-reinforced synthetic material. The member 21 is especially well adapted for smaller ball mills in which the forces to be absorbed and which result from the grinding acceleration are not so great as in larger mills. A structure such as member 21 is particularly advantageous, as it may consist of a pressed or cast molded part which may be cut into lengths and laid about the ball mill grinding chamber. In order to achieve better heat insulation with a supporting unit of this type, as also in the other embodiments, the annularly-shaped supporting feet 24 may be divided into individual shorter sections with only the elastic supporting ring being constructed as a continuous structure. This provides improved heat insulation. It also provides an ability to adapt without any problem to the outside surface of the ball mill chambers. The chambers do not always have a smooth surface. The irregularities of the surface, however, are compensated for by the elastic construction of the supporting ring without individual parts of the supporting member being too strongly stressed by the supporting element. The same advantage is apparent in still greater measure from an embodiment with supporting members extending transversely to the longitudinal direction of the supporting ring.

While preferred embodiments of the invention have been disclosed, it will be appreciated that these have been shown by way of example only and the invention is not to be limited thereto as other variations will be apparent to those skilled in the art and the invention is to be given its fullest possible interpretation within the terms of the following claims.

What is claimed is:

1. A vibrating mill having at least one grinding chamber surrounded by an insulating sleeve, said grinding chamber being fixed to a supporting frame to which a vibrating device means is attached, said vibrating mill comprising:

clamping means interconnecting said supporting frame and said grinding chamber;

an annular elastically deformable supporting device positioned between said clamping means and said grinding chamber, said device being effective to transfer the accelerating forces from the supporting frame to the grinding chamber, said device including an annular centrally disposed elastically deformable supporting portion;

outer central annular supporting means; and inner annular spaced supporting means connected to said annular centrally disposed elastically deformable supporting portion to form a bridge-like cross section therewith;

said outer central annular supporting means lying centrally between said inner annular spaced supporting means.

2. The vibrating mill of claim 1 wherein at least certain parts of said supporting device comprise a heat insulating material.

3. The vibrating mill of claim 1 wherein said outer central annular supporting means comprises at least one annularly-shaped axially extending supporting member and said inner annular supporting means comprises at least two annularly shaped supporting members laterally spaced from each other.

4. The vibrating mill of claim 1 wherein said annular centrally disposed elastically deformable supporting portion is preferably made of metal; and said inner annular supporting means is made of a fiber reinforced synthetic material.

5. A vibrating mill having at least one grinding chamber surrounded by an insulating sleeve, said grinding chamber being fixed to a supporting frame to which a vibrating drive means is attached, said vibrating mill comprising:

clamping means interconnecting said supporting frame and said grinding chamber;

an annular elastically deformable supporting device positioned between said clamping means and said grinding chamber, said device being effective to transfer the accelerating forces from the supporting frame to the grinding chamber, said device including an annular centrally disposed elastically deformable supporting portion;

outer central annular supporting means;

inner annular supporting means;

said annular centrally disposed elastically deformable supporting portion being preferably made of metal;

said inner annular supporting means preferably comprises a fiber reinforced synthetic material; and said inner annular supporting means further comprises a heat insulating material.

6. The vibrating mill of claim 1 wherein said supporting device is an integral unit formed of a fiber reinforced synthetic material and said device is elastically deformable and comprises a heat insulating material.

7. The vibrating mill of claim 6 wherein said integral supporting device is formed arcuately in cross-section, the inner annular supporting means having a pair of annularly extending supporting feet which are laterally offset with respect to each other.

8. The vibrating mill of claim 1 wherein said supporting device comprises at least two separate annular ring parts spaced in a radial direction.

9. The vibrating mill of claim 1 wherein said supporting device comprises at least three separate ring members spaced in radial direction with respect to each other with at least one of said ring members extending through the insulating sleeve.

10. The vibrating mill of claim 1 wherein said inner annular supporting means comprise rib members extending in a transverse direction of the annular centrally disposed elastically deformable supporting portion.

11. A vibrating mill having at least one grinding chamber surrounded by an insulating sleeve, said grinding chamber being fixed to a supporting frame with which a vibrating drive means is operatively associated, said vibrating mill comprising:

clamping means interconnecting said supporting frame and said grinding chamber;

an annular elastically deformable supporting device positioned between said clamping means and said grinding chamber, said device being effective to transfer the accelerating forces from the supporting frame to the grinding chamber, said device including supporting means arranged on the inner and outer side of said supporting device;

said supporting means on the outer side being laterally spaced from said supporting means on the inner side.

* * * * *